US008359680B2

(12) United States Patent
McQuary

(10) Patent No.: US 8,359,680 B2
(45) Date of Patent: Jan. 29, 2013

(54) COMFORT BEDPAN

(76) Inventor: Deborah Lynn McQuary, Granbury, TX (US)

( * ) Notice: Subject to any disclaimer, the term of this patent is extended or adjusted under 35 U.S.C. 154(b) by 608 days.

(21) Appl. No.: 12/548,243

(22) Filed: Aug. 26, 2009

(65) Prior Publication Data

US 2010/0050332 A1 Mar. 4, 2010

Related U.S. Application Data

(60) Provisional application No. 61/190,672, filed on Sep. 2, 2008.

(51) Int. Cl.
*A61G 9/00* (2006.01)

(52) U.S. Cl. ..... 4/456

(58) Field of Classification Search ..... 4/450–457, 4/DIG. 5

See application file for complete search history.

(56) References Cited

U.S. PATENT DOCUMENTS

| | | | | | |
|---|---|---|---|---|---|
| 897,434 | A | * | 9/1908 | Waltz | 4/450 |
| 1,623,602 | A | * | 4/1927 | Smith | 4/450 |
| D173,490 | S | | 4/1953 | Jones | |
| 2,724,122 | A | * | 11/1955 | Tennyson | 4/456 |
| 2,817,093 | A | * | 12/1957 | Rode | 4/456 |
| 2,886,827 | A | * | 5/1959 | Washington | 4/456 |
| 3,084,348 | A | * | 4/1963 | Parker et al. | 4/456 |
| D253,304 | S | * | 10/1979 | Nakao et al. | D24/123 |
| 5,689,840 | A | * | 11/1997 | Kuhlman | 4/452 |
| 2005/0066432 | A1 | * | 3/2005 | Gouldsworthy | 4/450 |
| 2011/0107508 | A1 | * | 5/2011 | Mosler et al. | 4/450 |

* cited by examiner

*Primary Examiner* — Huyen Le
(74) *Attorney, Agent, or Firm* — John Lindsay

(57) ABSTRACT

A bedpan for use by a patient may include a bottom section to define a cavity for waste of the patient and a top section to define a seat for the patient. The bottom section may be integral with the top section, and the top section may include a central soft texture section. The central soft texture section may be foam, and the bedpan may be formed by reaction injection molding process. The portion of the bedpan may include an anti-infection coating to prevent micro-bacterial formation and growth, and the bottom portion may include a rib for support.

8 Claims, 6 Drawing Sheets

COMFORT BEDPAN

PRIORITY

The present invention claims priority under 35 USC section 119 based upon a provisional application which was filed on Sep. 2, 2008 with a Ser. No. of 61/190, 672.

FIELD OF THE INVENTION

The present invention is related to bedpans and more particularly to a portable, cushioned disposable bedpan.

BACKGROUND

The necessity of bedpans for bed-ridden patients is of course well-known. The practice of the principal users of bedpans, institutions such as hospitals and nursing homes, is to utilize disposable products, i.e., products discarded after use by one patient (also known as single-patient use products). As a result, many products have had to change in order to permit production thereof at low costs commensurate with single-patient use. Bedpans are no exception.

A bedpan basically consists of a cavity defining a receptacle and a seat portion to support a patient. At one time bedpans were generally made of metal such as stainless steel. The basic shape and configuration of such bedpans was generally similar to those shown in Jones U.S. Design Pat. No. D-173,490, and Saulson U.S. Pat. No. 3,246,344. In such "standard" bedpans, the seat portions extend inwardly from the peripheral wall to define a generally central opening accessing the receptacle.

One of the advantages of this design was its anti-splashback characteristics particularly during transportation. The overhanging inwardly directed seat would inhibit splashback and spillage of the contents when a bedpan was being moved after use. While some bedpans were later made of a plastic material in order to reduce costs, the basic configuration remained unchanged.

Both of these types of bedpans were relatively expensive and therefore were not disposable, i.e., they were intended for multiple-patient use. As such, it was necessary to autoclave or sterilize them before they could be reused. The resulting costs were high, both acquisition costs because of the material used and/or cost of production, and the cost of use was high as a result of the requirements and the expenses of sterilization.

Clearly, if a single-patient use or disposable bedpan could be produced to satisfy the needs of the institutions which are the most prevalent users thereof, it would be expected that such a bedpan would be received with great enthusiasm. Such was the case.

Thus, when a bedpan such as that disclosed in Painter U.S. Design Pat. No. D-216,058 first appeared on the market, it was well received even though it did not "look" like a bedpan. The Painter bedpan was advantageous in that it was injection-molded and therefore was inexpensive to make. Because of its configuration, a plurality of such bedpans could be nested one within the other, to minimize the amount of storage space required.

One problem with the Painter et al. bedpan, however, derived directly from the manufacturing technique used and the resulting low cost. Because it was injection-molded, it was designed with the seat portion extended outwardly from the walls of the receptacle rather than inwardly as did the then "standard" bed pans. Not only did this result in a bedpan which had a somewhat different appearance from the standard bedpan, but the tapering walls of the receptacle portion and the outwardly directed seat did not provide any undercut or catch to prevent splashback and spills. In spite of this, the bedpan was widely used because it was uniquely adaptable to single-patient use and because of the reduced storage space required due to its nestability.

Subsequently, bedpans such as those disclosed in Rickmeier Design Pat. No. D-216,059, and Rickmeier U.S. Pat. No. 3,597,771, appeared on the market. These bedpans, which were designed to permit injection-molding, also had an undercut portion to inhibit splashback and spills. While this feature was, in fact, desirable from the user's standpoint, more space was required to store a supply of such bedpans than was required to store the Painter type bedpans because the Rickmeier style would not nest. Thus, hospitals were faced with a choice between a type of single-patient use bedpan that would store in a minimum amount of space but which did not have a desired antisplashback capability and a bedpan having such a capability but which required increased amount of space to store because of its inability to nest.

Other configurations of bedpans which would facilitate nesting were also in existence. See, e.g., British Pat. No. 992,403. However, just as in Painter, no such bedpan of which applicant is aware really inhibited splashback. Even the British bedpan, which included a projecting transverse barrier in the bottom of the container portion to inhibit surging of the contents when the bedpan was being carried did not inhibit splashback and spillage. In order to prevent spillage, this bedpan was provided with some type of flexible cover that was placed over it when it was carried.

SUMMARY

A bedpan for use by a patient may include a bottom section to define a cavity for waste of the patient and a top section to define a seat for the patient.

The bottom section may be integral with the top section, and the top section may include a central soft texture section.

The central soft texture section may be foam, and the bedpan may be formed by reaction injection molding process.

The portion of the bedpan may include an anti-infective coating to prevent micro-bacterial formation and growth, and the bottom portion may include a rib for support.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
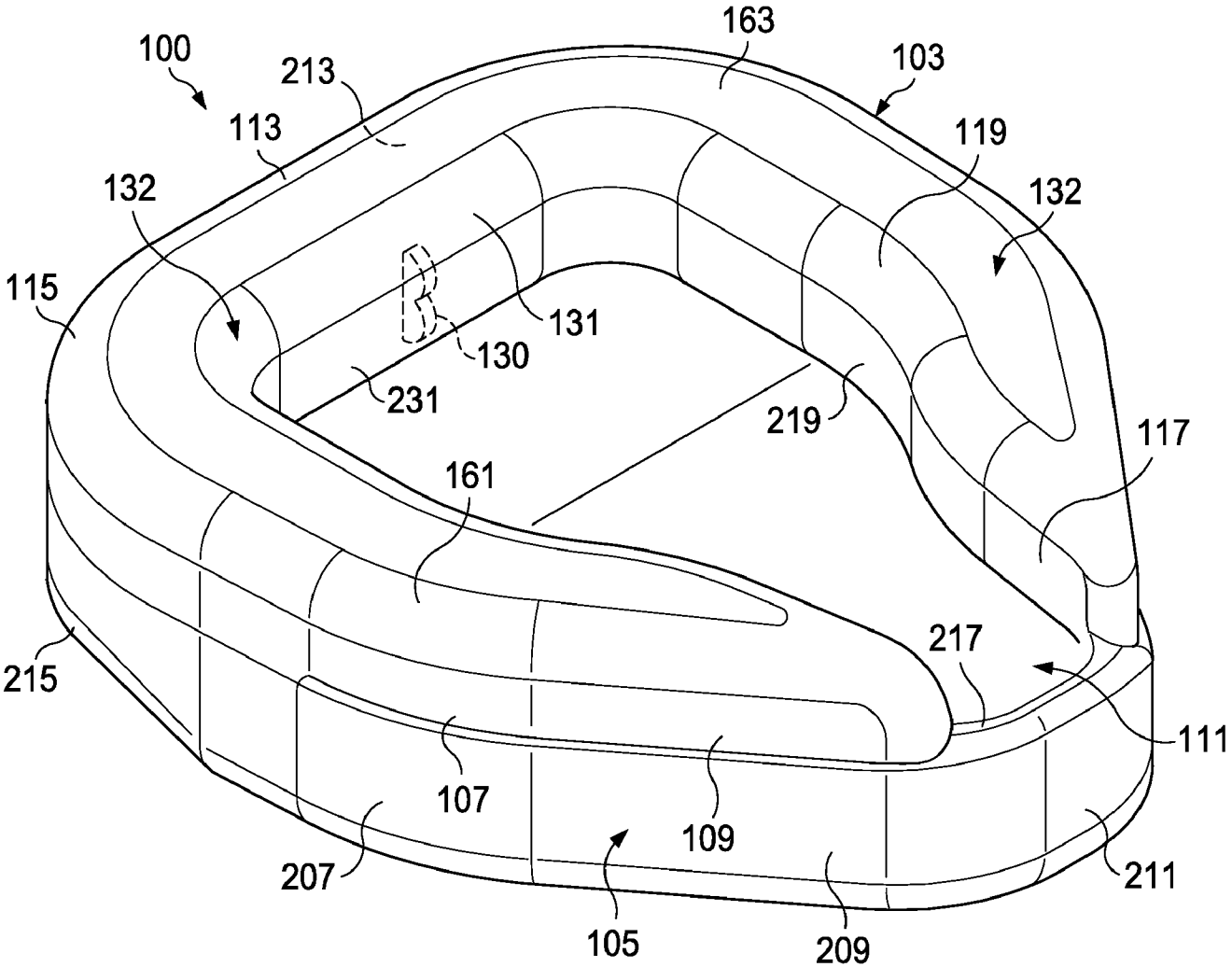
FIG. 1 illustrates a perspective view of the bedpan of the present invention.

The present invention is related to making available a portable cushioned disposable bedpan for a patient that may hold human waste and exhibits many advantages. The bedpan 100 of the present invention may be designed for single patient use. The bedpan 100 is light weight and able to sustain cleaning with an antibacterial soap. The bedpan 100 of the present invention may include a top section 103 which corresponds to the seat to provide support for the user of the bedpan and a bottom section 105 which corresponds to a receptacle to hold the waste products. The top section 103 and the bottom section 105 may be formed from molding or other appropriate methods. The bottom section 105 may include a substantially vertical ribs in order to allow thinner material to be employed but provide strength and stability to the bedpan 100. The bedpan 100 of the present invention may be constructed as a single configuration article without seams, with being substantially continuous, without sharp edges or attachments, namely an integral bedpan. The bedpan 100 of the present invention may be able to hold significant weight and may be able to hold patients up to 300 pounds or more. The top section may include an interior foam center or section which may be more flexible than the bottom section. The top section may be covered with a semi-soft foam or painted urethane or self skin urethane to provide a soft texture (substantially preventing the absorption of moisture). The top portion 103 may be constructed of soft plastic or a suitable any liquid impermeable material. There may be no seams between the bottom section 105 and the top section 103. The bottom section 105 may be considered the structure of the bedpan and may be formed from hard rigid plastic or other suitable materials. The bottom surface of the bottom section 105 may be inclined in order to provide flexibility so that the bedpan may move as the patient moves. The bottom section 105 may be rigid. The sides of the bottom section 105 extends upwards and cooperates with the sides of the top section 103 and the top surface 163 of the top section 103 to form the support for the seat. The bedpan 100 provides a comfortable seating area. And the bedpan 100 may reduce anxiety, helps and prevention of skin breakdown, places less strain on body parts, prevents frequent use which may result in less bladder and kidney infections and helps eliminate constipation. The bedpan surface is easy to move around long use, and the bedpan is easy for the patient to slide on and off and conforms to the patients buttocks. The cushioned area prevents surface tension and is less likely to stick to the patient skin as other present-day slick surfaces. The shape of the bedpan 100 is advantageous and the shape of the back portion supports the areas of the musculokeletal system.

FIG. 1 illustrates a perspective view of the bedpan 100. The top section 103 may include an outer side surface 107 which may include an outer inclined side surface 109 which may incline inwards to reduce the dimension of the bedpan 100 in the front. The periphery of the top section 103 may be discontinuous and may include a top section aperture 111 which may be defined by ends of the outer inclined side portions 109. The outer back surface 113 may cooperate with the outer side surface 107 by an outer curve corner 115. The top section may include an inner side depression surface 117 which may extend to inner side curved surface 119 which may be connected to the inner back surface 131. The outer side surface 107, the outer inclined side portions 109, the outer back surface, the inner side depression surface 117, the inner side curved surface 119 and the inner back surface 131 may define a interior foam section 132. The top section 103 may include a chamfered non sharp edge 161 around the periphery of the top section 103 and between the top surface 163 of the top section 103 and the outer side surface 107.

The bottom section 105 may include an outer side surface 207 which may cooperate with the outer side surface 107 and which may include an outer inclined side surface 209 which may cooperate with the outer inclined side surface 109. The periphery of the bottom section 105 may be continuous and may include a bottom front section 211 which may cooperate with the top section aperture. The outer back surface 213 may cooperate with the outer back surface 113 and may cooperate with the outer side surface 207 by an outer curve corner 215. The bottom section may include an inner side surface 217 which may extend to inner side curved surface 219 which may be connected to the inner back surface 231. The bottom section 105 may include a rib 130 to provide additional support.

Figure 2:
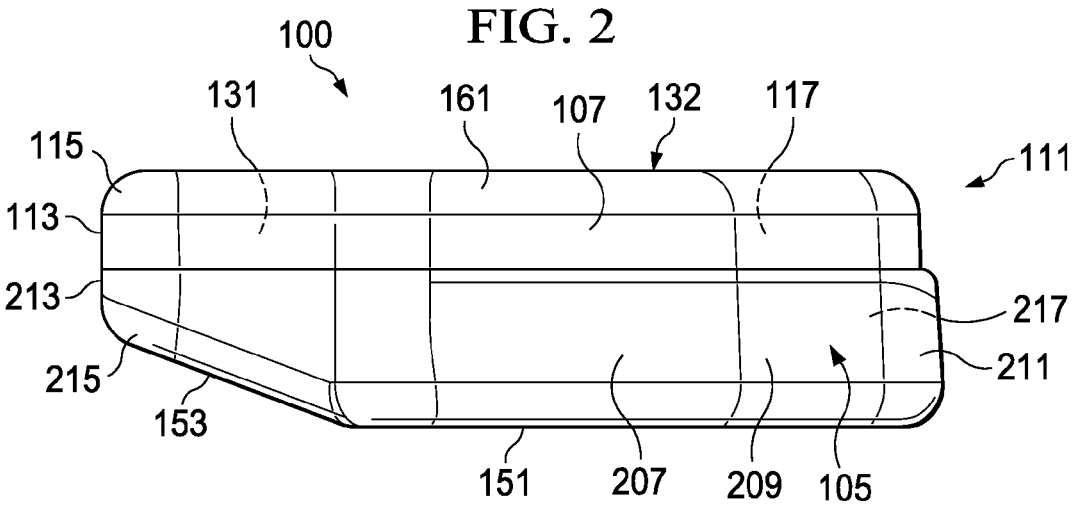
FIG. 2 illustrates a side view of the bedpan of the present invention.

FIG. 2 illustrates a side view of the bedpan 100. The top section 103 may include an outer side surface 107 which may include an outer inclined side surface 109. The periphery of the top section 103 may be discontinuous and may include a top section aperture 111 which may be defined by ends of the outer inclined side portions 109. The outer back surface 113 may cooperate with the outer side surface 107 by an outer curve corner 115. The top section may include an inner side depression surface 117 which may extend to inner side curved surface 119 which may be connected to the inner back surface 131. The outer side surface 107, the outer inclined side portions 109, the outer back surface, the inner side depression surface 117, the inner side curved surface 119 and the inner back surface 131 may define a interior foam section 132.

The bottom section 105 may include an outer side surface 207 which may cooperate with the outer side surface 107 and which may include an outer inclined side surface 209 which may cooperate with the outer inclined side surface 109. The periphery of the bottom section 105 may be continuous and may include a bottom front section 211 which may cooperate with the top section aperture. The outer back surface 213 may cooperate with the outer back surface 113 and may cooperate with the outer side surface 207 by an outer curve corner 215. The bottom section may include an inner side surface 217 which may extend to inner side curved surface 219 which may be connected to the inner back surface 231.

FIG. 2 illustrates the bottom surface 151 which may include an inclined portion 153 which may be at an angled relationship with respect to the bottom surface 151 to allow the bedpan 100 to be moved more easily by reducing the friction with the bed coverings.

Figure 3:
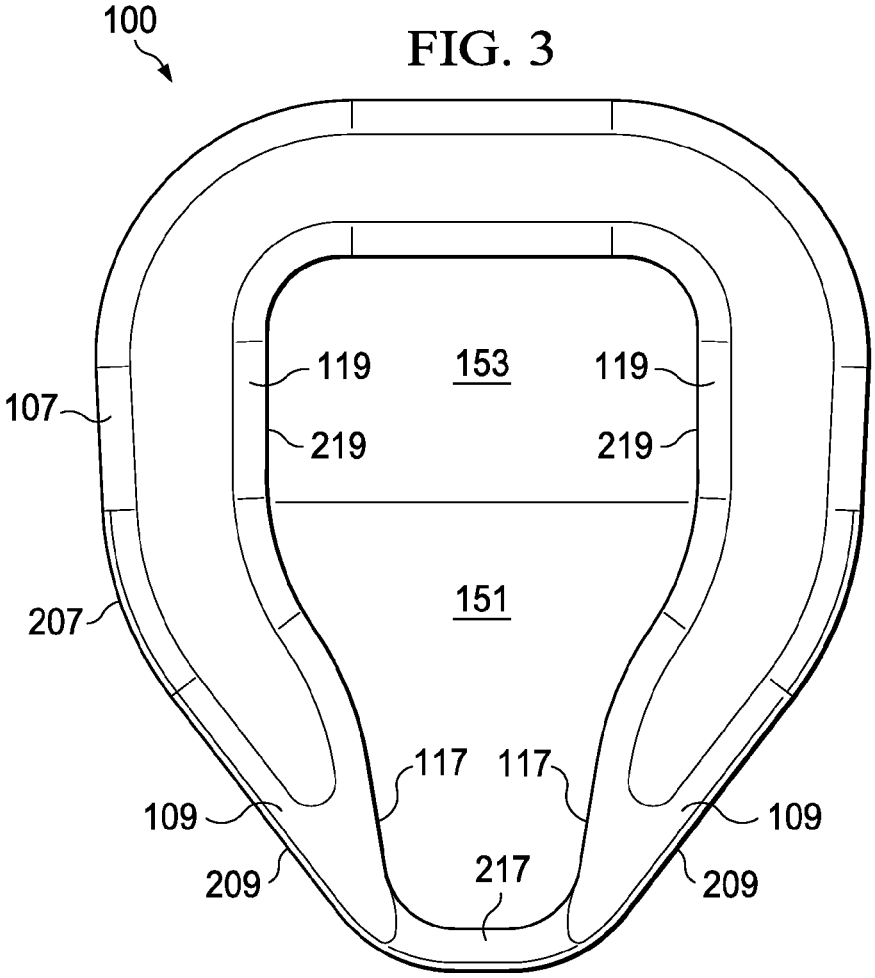
FIG. 3 illustrates a top view of the bedpan of the present invention.

FIG. 3 illustrates a top view of the bedpan 100. The top section 103 may include an outer side surface 107 which may include an outer inclined side surface 109. The periphery of the top section 103 may be discontinuous and may include a top section aperture 111 which may be defined by ends of the outer inclined side portions 109. The outer back surface 113 may cooperate with the outer side surface 107 by an outer curve corner 115. The top section may include an inner side depression surface 117 which may extend to inner side curved surface 119 which may be connected to the inner back surface 131. The outer side surface 107, the outer inclined side portions 109, the outer back surface, the inner side depression surface 117, the inner side curved surface 119 and the inner back surface 131 may define a interior foam section 132.

The bottom section 105 may include an outer side surface 207 which may cooperate with the outer side surface 107 and which may include an outer inclined side surface 209 which may cooperate with the outer inclined side surface 109. The periphery of the bottom section 105 may be continuous and may include a bottom front section 211 which may cooperate with the top section aperture. The outer back surface 213 may cooperate with the outer back surface 113 and may cooperate with the outer side surface 207 by an outer curve corner 215. The bottom section may include an inner side surface 217 which may extend to inner side curved surface 219 which may be connected to the inner back surface 231.

FIG. 3 illustrates the bottom surface 151 which may include an inclined portion 153 which may be at a angled relationship with respect to the bottom surface 151 to allow the bedpan 100 to be moved more easily by reducing the friction with the bed coverings.

Figure 4:
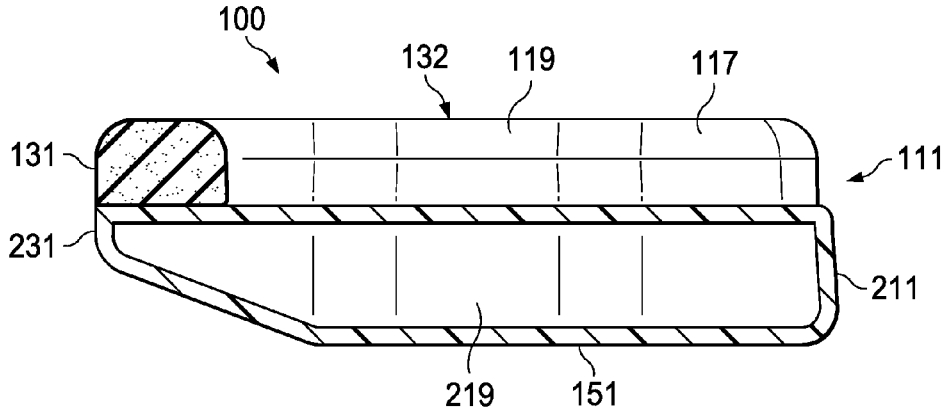
FIG. 4 illustrates a sectional view of the bedpan of the present invention.

FIG. 4 illustrates a sectional view of the bedpan 100. The top section 103 may include an outer side surface 107 which may include an outer inclined side surface 109. The periphery of the top section 103 may be discontinuous and may include a top section aperture 111 which may be defined by ends of the outer inclined side portions 109. The outer back surface 113 may cooperate with the outer side surface 107 by an outer curve corner 115. The top section may include an inner side depression surface 117 which may extend to inner side curved surface 119 which may be connected to the inner back surface 131. The outer side surface 107, the outer inclined side portions 109, the outer back surface, the inner side depression surface 117, the inner side curved surface 119 and the inner back surface 131 may define a interior foam section 132. The bottom section 105 may include an outer side surface 207 which may cooperate with the outer side surface 107 and which may include an outer inclined side surface 209 which may cooperate with the outer inclined side surface 109. The periphery of the bottom section 105 may be continuous and may include a bottom front section 211 which may cooperate with the top section aperture. The outer back surface 213 may cooperate with the outer back surface 113 and may cooperate with the outer side surface 207 by an outer curve corner 215. The bottom section may include an inner side surface 217 which may extend to inner side curved surface 219 which may be connected to the inner back surface 231.

FIG. 4 illustrates the bottom surface 151 which may include an inclined portion 153 which may be at an angled relationship with respect to the bottom surface 151 to allow the bedpan 100 to be moved more easily by reducing the friction with the bed coverings.

FIG. 4 additionally illustrates that the top section 103 may be soft vinyl and the outer side surface 107, the outer inclined side portions 109, the outer back surface, the inner side depression surface 117, the inner side curved surface 119 and the inner back surface 131 may define a interior foam central section 132. The bottom surface 151 of the bedpan 100 may include a textured surface or other appropriate treatment in order to increase the friction with respect to other surfaces of the bedpan 100 and in order to provide additional friction with the bed surface (not shown) to provides stability for the bedpan 100.

Figure 5:
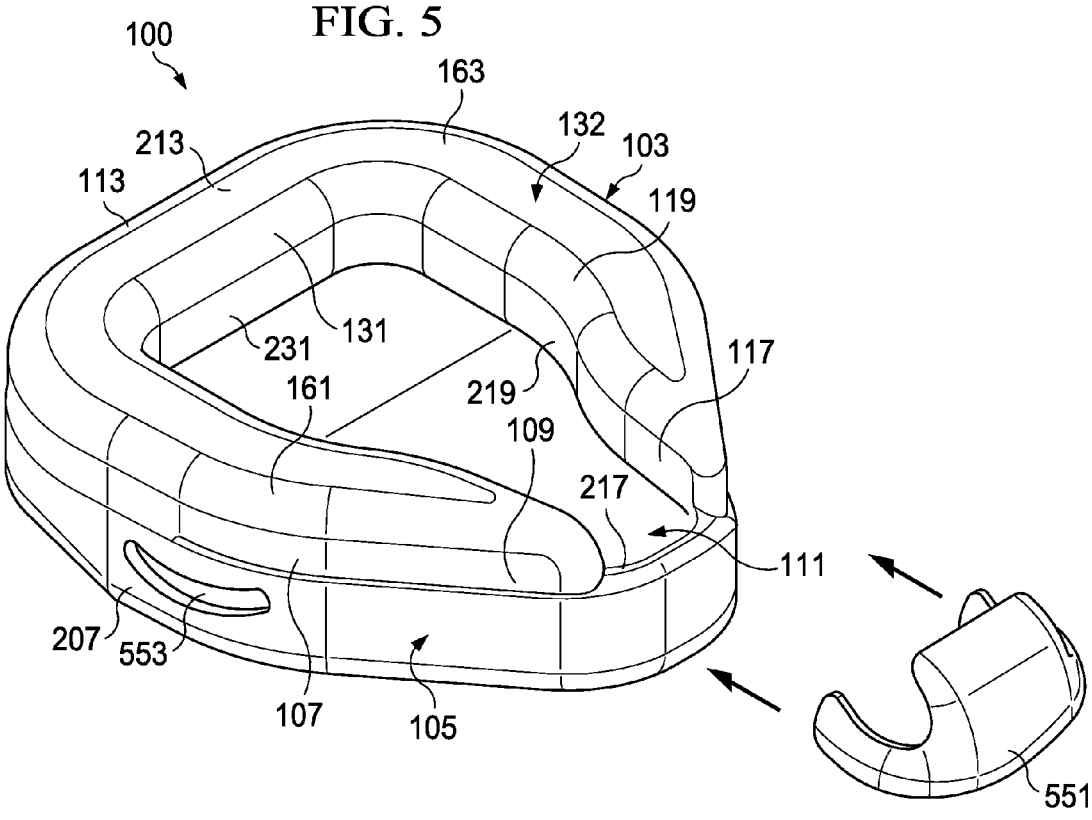
FIG. 5 illustrates a perspective view of the bedpan with a cover and handle.

FIG. 5 illustrates a front cover 551 which may be curved in order to cooperate with the bottom front section 211 and may cover the top section aperture 111 by a friction fit (or other types of attachment). The front cover 551 may prevent urine from escaping the bedpan 100, especially when being used by males and may be detachably connected to the bedpan 100 so that it can be removed, for example for use with a female. FIG. 5 shows the front cover 511 detached from the bedpan 100.

FIG. 5 additionally illustrates a depression 553 which may be formed in the side surface, front surface or back surface of the bedpan 100 and may be sufficiently sized in order to be used as a handle. Alternatively, a handle which extend from the surface of the bedpan 100 may be employed.

Figure 6:
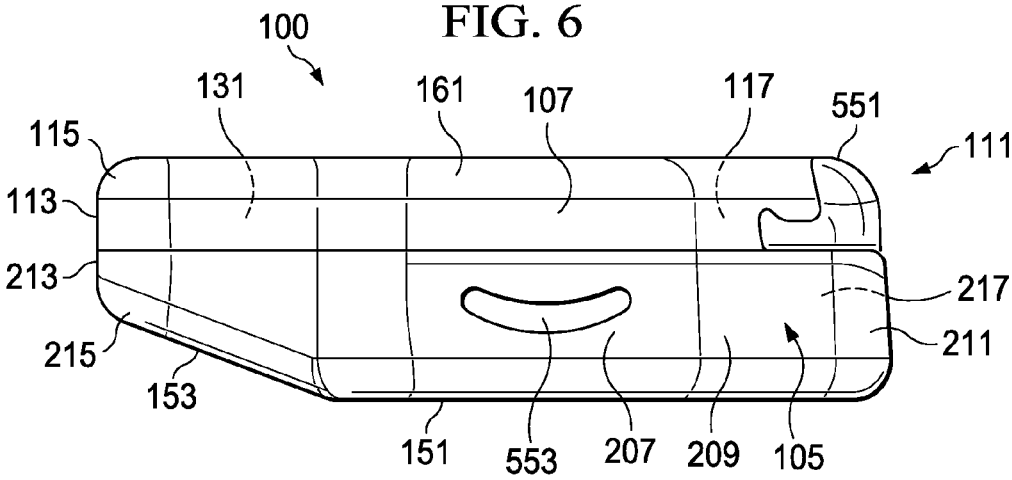
FIG. 6 illustrates a side view of the bedpan with a cover and handle.

FIG. 6 illustrates a front cover 551 which may be curved in order to cooperate with the bottom front section 211 and may cover the top section aperture 111 by a friction fit (or other types of attachment). The front cover 551 may prevent urine from escaping the bedpan 100, especially when being used by males.

FIG. 6 additionally illustrates a depression 553 which may be formed in the side surface, front surface or back surface of the bedpan 100 and may be sufficiently sized in order to be used as a handle. Alternatively, a handle which extend from the surface of the bedpan 100 may be employed.

Figure 7:
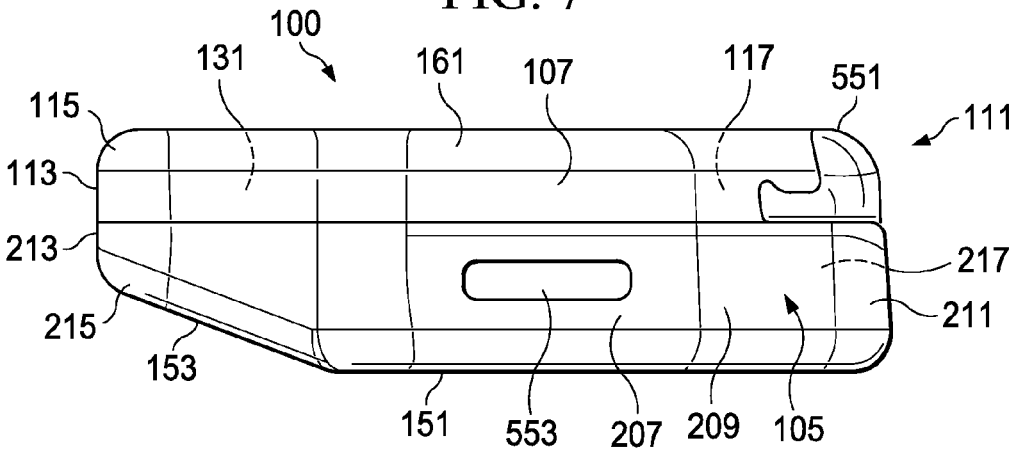
FIG. 7 illustrates another side view of the bedpan with the cover and handle.

FIG. 7 illustrates a front cover 551 which may be curved in order to cooperate with the bottom front section 211 and may cover the top section aperture 111 by a friction fit (or other types of attachment). The front cover 551 may prevent urine from escaping the bedpan 100, especially when being used by males.

FIG. 7 additionally illustrates a depression 553 which may be formed in the side surface, front surface or back surface of the bedpan 100 and may be sufficiently sized in order to be used as a handle. Alternatively, a handle which extend from the surface of the bedpan 100 may be employed.

Figure 8:
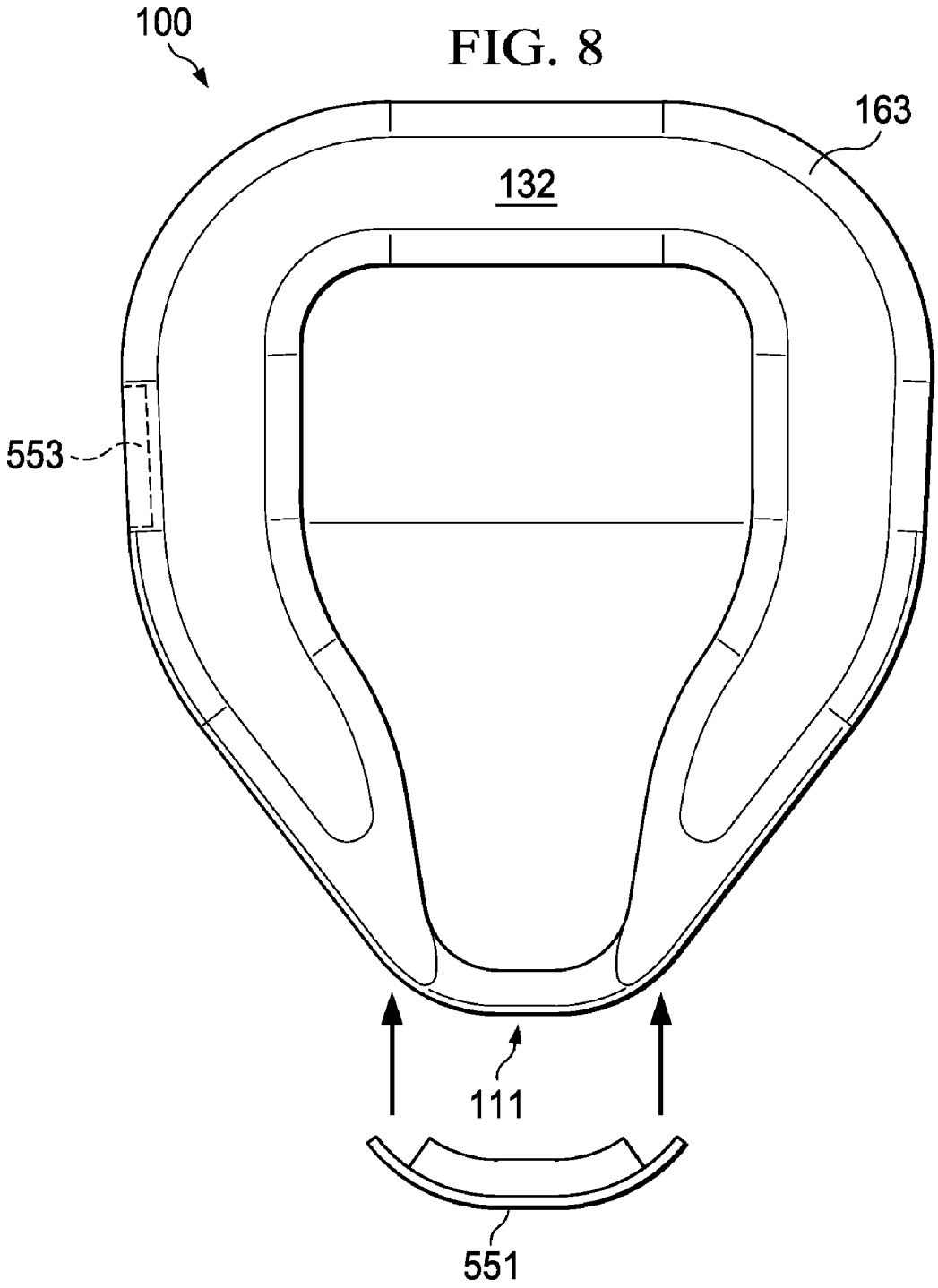
FIG. 8 illustrates a top view of the bedpan with the cover and handle.

FIG. 8 illustrates a front cover 551 which may be curved in order to cooperate with the bottom front section 211 and may cover the top section aperture 111 by a friction fit (or other types of attachment). The front cover 551 may prevent urine from escaping the bedpan 100, especially when being used by males.

FIG. 8 additionally illustrates a depression 553 which may be formed in the side surface, front surface or back surface of the bedpan 100 and may be sufficiently sized in order to be used as a handle. Alternatively, a handle which extend from the surface of the bedpan 100 may be employed.

Figure 9:
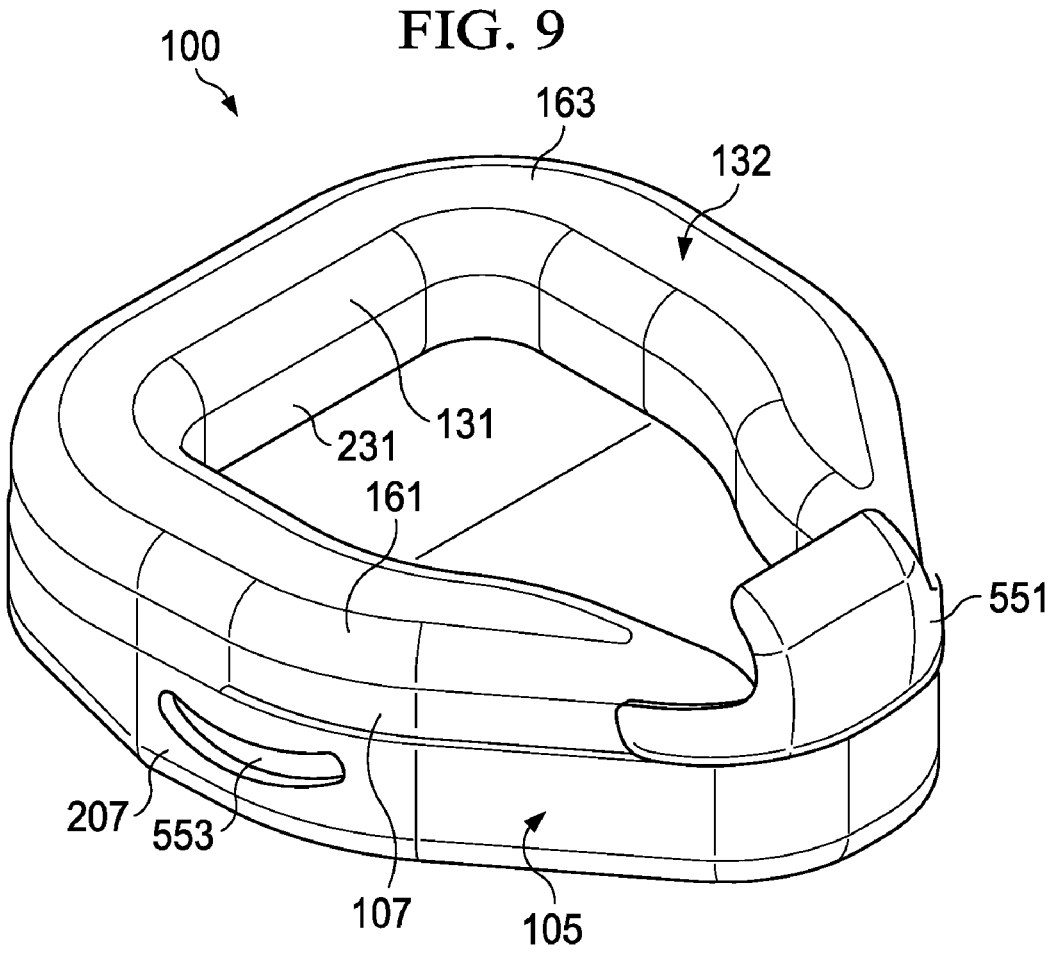
FIG. 9 illustrates a perspective view of the bedpan with the cover in position and handle.

FIG. 9 illustrates a front cover 551 which may be curved in order to cooperate with the bottom front section 211 and may cover the top section aperture 111 by a friction fit (or other types of attachment). The front cover 551 may prevent urine from escaping the bedpan 100, especially when being used by males. FIG. 9 illustrates that the front cover 511 has been positioned over the top section aperture 111 and held in position by friction.

FIG. 9 additionally illustrates a depression 553 which may be formed in the side surface, front surface or back surface of the bedpan 100 and may be sufficiently sized in order to be used as a handle. Alternatively, a handle which extend from the surface of the bedpan 100 may be employed.

There are many processes to construct the bedpan 100. The reaction injection molding can make the bedpan 100 as one piece by first forming a mold of the bottom section 105 and a second mold of the top section 103. The first and second molds are placed into a reaction injection tool and a self sealing material is injected to form the bedpan 100. Alternatively, a casting material such as foam which may be open or closed cell, urethane, rubber, so Silicon, or some TPE alloy to adhere to the base construction. The foam may be covered by vinyl or other material suitable for skin contact. The materials are calling injected into one mold or over the mold.

The base bottom half material may be different from the top surface and may be any thermoplastic material including but not exclusively ABS, styrene, Polypropylene, polyethylene or an alloy combination. The top and bottom sections can be sealed together.

The bedpan 100 may be formed by the reaction injection molding which may be also known as liquid reaction molding or high pressure impingement mixing. The sizing of the bottom section and the top section may be based on existing bedpans geometries. The contour features of the bedpan are included to streamline, and enhance and differentiate the bedpan.

The bottom section may have multiple mechanical catch tabs to function as mechanical interlocks for the bottom section and the top section of the bedpan. Mold shut offs for the top section may occur at the parameter parting to eliminate sharp edges. The exposed flash points may be eliminated when in direct contact with fleshy tissues.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A bedpan for use by a patient, comprising:

a bottom section to define a cavity for waste of the patient, said bottom section further comprising a substantially planar front section and a substantially planar rear section, said rear section angularly joined to said front section, whereby said rear section inclines relative to said front section;

said bottom section integrally joined to a top section;

said top section to define a seat for the patient, said top section further comprising a linear rear section integrally joined to two arms, said arms extending frontally, said top section presenting inner and outer edges surrounding a central section; and said edges being comprised of a rigid material and said central section comprised of softer material.

2. A bedpan for use by a patient as in claim 1, wherein said central softer texture section is foam.

3. A bedpan for use by a patient as in claim 1, wherein a portion of the bedpan includes an anti-infection coating operable to prevent micro-bacterial formation and growth.

4. A bedpan for use by a patient as in claim 1, wherein the bedpan includes a depression adapted to be used as a handle.

5. A bedpan for use by a patient as in claim 1, wherein the bedpan includes a front cover attached to the front section of said bedpan, operable to prevent liquid from being ejected or splashed from said bedpan, said front cover comprised of a lip rising above the top edge of the bottom section.

6. A bedpan for use by a patient as in claim 5, wherein said front cover is a detachable.

7. The bedpan according to claim 1, wherein the angle between said rear section of said bottom section and said front section of said bottom section is about 160 degrees.

8. A bedpan for use by a patient, comprising:

a bottom section having a height of about 2.5 inches to define a cavity for receipt of waste of the patient, said bottom section further comprising a substantially planar front section and a substantially planar rear section having a length of about 4 inches, said rear section angularly joined to said front section, whereby said rear section inclines relative to said front section at an angle of about 20 degrees;

said bottom section integrally joined to a top section;

said top section defining a seat for the patient and having a height of about 1.5 inches, said top section further comprising a linear rear section having a length of about 2.5 inches and integrally joined to two arms, said arms having a length of about fourteen inches and extending frontally, said top section presenting inner and outer edges surrounding a central section; and said edges being comprised of a rigid material and said central section comprised of softer material.

* * * * *